United States Patent [19]

Piramoon

[11] Patent Number: 4,501,565

[45] Date of Patent: Feb. 26, 1985

[54] CENTRIFUGE BUCKET HANGER WITH LOADING RAMP

[75] Inventor: Alireza Piramoon, Santa Clara, Calif.

[73] Assignee: Beckman Instruments, Inc., Fullerton, Calif.

[21] Appl. No.: 499,563

[22] Filed: May 31, 1983

[51] Int. Cl.[3] ..... B04B 5/02

[52] U.S. Cl. ..... 494/85; 494/20

[58] Field of Search ..... 494/16, 20, 85; 248/544; 308/2 R

[56] References Cited

U.S. PATENT DOCUMENTS 3,454,217 7/1969 Harbott ..... 494/20

4,236,666 12/1980 Aeschlimann ..... 494/20

*Primary Examiner*—Robert W. Jenkins

*Attorney, Agent, or Firm*—R. J. Steinmeyer; P. R. Harder; S. R. Markl

[57] ABSTRACT

A hanger for supporting one side of a swinging bucket in a centrifuge rotor. The hanger is adapted for use in pairs, mounted one on each side of a space in a rotor, for containing a swinging bucket. The hanger is provided with an opening for receiving the pivot pins of the bucket and supporting it thereby. Ramp means are disposed on the upper side of the hanger for guiding the pivot pin of the bucket into the opening in the hanger, thereby enabling the pivot pin to be self-seating in the hanger through the effect of gravity when the bucket is deposited in the rotor. The hanger includes spring means for enabling the pivot axis of the bucket to move radially outward in response to centrifugal force and enable the bucket to engage a portion of the rotor.

10 Claims, 8 Drawing Figures

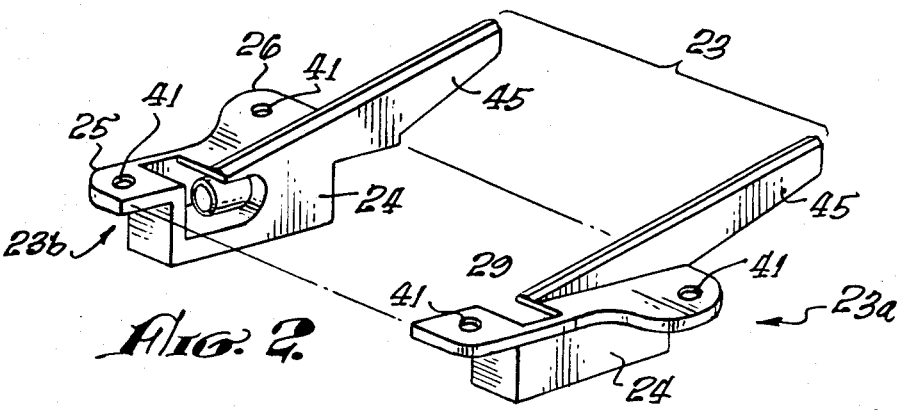
FIG. 2.
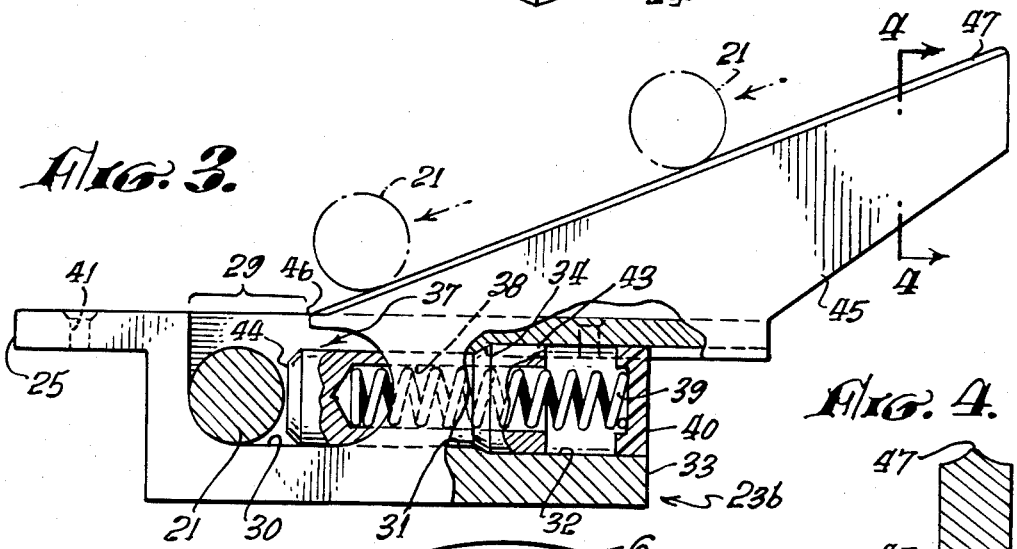
FIG. 3.
FIG. 4.
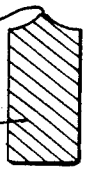
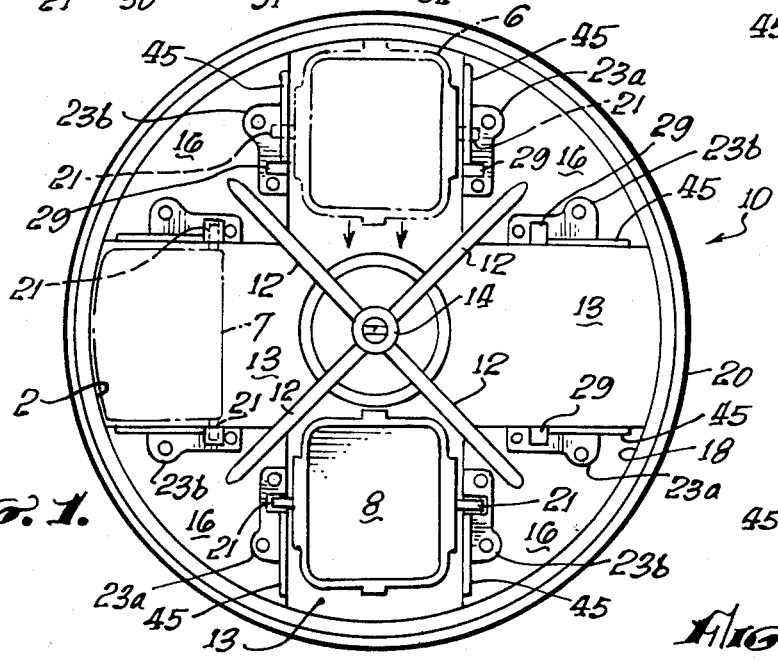
FIG. 1.
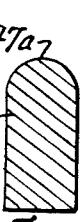
FIG. 5.

CENTRIFUGE BUCKET HANGER WITH LOADING RAMP

BACKGROUND OF THE INVENTION

The present invention relates to centrifuges, and more particularly to improvements in apparatus for mounting a centrifuge bucket on the rotor of a centrifuge.

A possible problem with centrifuges having swinging buckets is that the user may fail to properly mount a bucket in the rotor of the centrifuge. During operation the bucket may become detached from the rotor and flung outwardly with great force. At best, such a mishap is certain to cause serious damage to the centrifuge and deprive the user of its service until suitable repairs are effected. At worst, it is well within the realm of possibility that such a mishap could not only destroy the machine, but also cause injury to the operator.

In view of the serious consequences associated with mishaps of the kind described, manufacturers have gone to great lengths to strengthen centrifuge enclosures in order to prevent injuries to users. Through the application of modern metallurgy and advanced design techniques, these efforts have largely succeeded in assuring the safety of the centrifuge operator, which is the maker's paramount concern.

Current attention is being directed toward finding ways to reduce the expense of repairs and the downtime that results when a rotor mishap occurs. Clearly, the most direct and effective approach to the problem would be to simply prevent the occurrence of such mishaps, or at least, reduce the frequency of their occurrence. Accordingly, it has been recognized that this end may be largely realized by making certain improvements in the design of swinging bucket centrifuge rotors which is the subject of the present invention.

SUMMARY OF THE INVENTION

The present invention is directed to improvements in hangers for supporting one side of a swinging bucket in a centrifuge rotor. The hanger of the invention is adapted for use in pairs, mounted one on each side of a space in a rotor for containing a swinging bucket. Such buckets have a pivot axis defined by a pair of pivot pins which are disposed one on each side of the bucket. The hanger is provided with an opening for receiving the pivot pins of the bucket and supporting it thereby.

Ramp means are disposed on the upper side of the hanger for guiding the pivot pin of the bucket into the opening in the hanger. This provision enables the pivot pin to be self-seating in the hanger by the influence of gravity when the bucket is deposited in the rotor. Thus, the likelihood of a mishap occurring because of an improperly installed bucket is materially and effectively reduced.

BRIEF DESCRIPTION OF THE DRAWINGS

FIG. 1 is a plan view of a centrifuge rotor incorporating a plurality of hangers constructed in accordance with the present invention.

FIG. 2 is a perspective view of the hanger of the invention shown in right and left orientations thereof.

FIG. 3 is a side elevation in partial cross section of one of the hangers of FIG. 2.

FIG. 4 is a cross section of a portion of the hanger of FIG. 3 taken on the line 4—4.

FIG. 5 is a cross section of a portion of the hanger of FIG. 3 taken on the line 4—4 in an alternate embodiment thereof.

DETAILED DESCRIPTION

Figure 6:
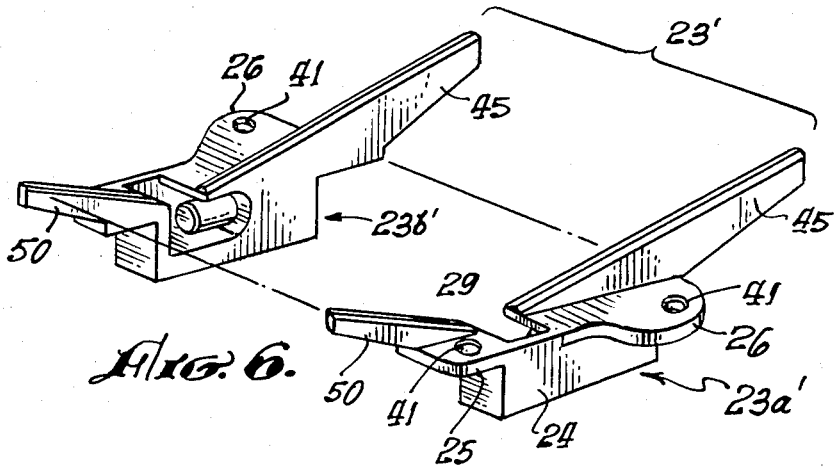
FIG. 6 is a perspective view of the hanger of the invention in another form and in right and left orientations thereof.

The present invention discloses improvements in hangers used for supporting swinging buckets in a centrifuge rotor. These improvements entail the use of ramp means for guiding a bucket into a seated position in a pair of hangers mounted in a centrifuge rotor. The bucket is provided with a pivot pin on each side, by which it is supported by the ramp means and hangers. When the bucket is placed with its pivot pins on the ramp means, it is caused to slide by gravity until its pivot pins each engage a cradle-like opening in each of two hangers and it becomes pivotally mounted or seated therein. In this way, the bucket is self-seating in the rotor, and accordingly, the likelihood of a mishap occurring during operation because of an improperly mounted bucket is greatly diminished.

While the improvements disclosed herein are believed to have broad application in the centrifuge art, the specific embodiments disclosed have direct application to centrifuge rotors and hangers disclosed in a prior U.S. patent application Ser. No. 400,528 issued to Alireza Piramoon [check spelling] et al., and assigned to Beckman Instruments, Inc., the assignee of the present invention. Accordingly, the subject matter of the aforesaid patent is incorporated herein by reference.

Referring now to the drawings, there is shown in FIG. 1 a plan view of a centrifuge rotor 10 adapted for use with a plurality of swinging buckets 8. In the instant example, only one bucket 8, is shown in solid lines to illustrate the bucket position when the rotor is stationary. The rotor 10 includes four spaced arms 12 which radiate outward from a center member 14, like the spokes of a wheel. The outward end of each arm 12 terminates in an extension 16. The extension 16 has the shape of a 90° circular sector and each of the four extensions 16 is joined to a circular pressure ring 18. Preferably, the pressure ring 18, extensions 16, arms 12 and center member 14 are fabricated as a one-piece forging of a high-strength material such as titanium. The forged structure is enclosed on its perimeter and underside by a one-piece outer shell 20. The outer shell 20 is used in conjunction with a cover which is not illustrated, but is somewhat similar in appearance to the lid of a kettle. When so combined, the shell 20 and the cover serve as a windshield to reduce the windage, turbulence and resultant noise of the rotor when it is rotating at high speed within the chamber of the centrifuge.

Between each of the extensions 16 there is a space 13 for containing a bucket, such as bucket 8. The bucket 8 has a pivot axis defined by a pair of pivot pins 21 which are disposed one on each side of the bucket. It will be seen that each space 13 is bordered on two sides by an extension 16. The extension 16 may be provided with a notch-like recess at the junction of its top and side surface adjacent space 13 to accommodate recessed mounting of a hanger 23*a* or 23*b*.

Referring now also to FIGS. 2–5, it will be seen that the hangers comprise a right and left oriented pair 23, consisting of individual hangers 23*a* and 23*b*. The individual hangers 23*a* and 23*b* are identical, except that one is a reverse or mirror image of the other. The hangers 23 include an elongated, generally rectangular body 24. The hangers 23 are adapted for recessed mounting and are provided with a pair of mounting tabs or "ears" 25 and 26 which extend outwardly from each end of the body 24. Each ear 25 and 26 may contain a mounting hole 41 to enable the hanger 23 to be secured to the rotor by the use of rivets or screws.

The hangers 23 are each provided with an opening 29 for receiving and supporting the pivot pins 21 of a bucket 8. The opening 29 is essentially vertical, transverse to the longitudinal axis of the hanger body 24 and intersects with an elongated horizontal slot 30. Also intersecting the horizontal slot 30 is a cylindrical bore 31 which extends from the slot 30 to the end 33 of the rectangular body 24. The cylindrical bore 31 contains a counterbore 32 at the end 33, providing a shoulder 34 within the counterbore 32.

A cylindrical plunger 37 is slidably disposed in the bore 31. A hole 38 is drilled partway through the plunger along the longitudinal axis thereof for receiving one end of a coiled compression spring 39. The other end of the spring 39 bears against an end cap 40 which closes the open end of the counterbore 32. The end cap 40 may be secured in the counterbore 32 in any of a variety of ways such as, for example, by making a threaded engagement between the cap and the mouth of the counterbore. Alternatively, the cap may be staked in place, pinned or secured with a set screw. The spring 39 exerts a force on the plunger 37 urging it in a direction to intersect with slot 30 and opening 29. The end of the plunger most remote from opening 29 has a larger outside diameter than the rest of the plunger, in the manner of an end flange 43. This flange 43 is contained within the counterbore 32 and serves to limit the travel of the plunger in the direction of slot 29.

In the normal static condition (i.e., when the rotor 10 is at rest), the flange 43 is in abutting contact with shoulder 34 in the counterbore 32 as a result of the force exerted by spring 39. Thus, the plunger 37 cannot extend further in the direction of slot 29. The length of plunger 37 is selected so that in the static condition, there is a slight clearance between the plunger face 44 and the pivot pin 21. While the amount of clearance is not critical, it should be sufficient to allow the pivot pin 21 to drop into the opening 29 under the influence of gravity without encountering interference from the plunger 37. (This aspect of the invention will be more fully discussed elsewhere hereinafter.) Accordingly, satisfactory operation may be obtained when the clearance between the pivot pin 21 and the plunger face 44 is made to be about 0.25 mm (0.010 inches).

In FIG. 1, the lowermost bucket 8 (shown in solid lines) illustrates the position of the bucket correctly mounted in the rotor 20 when the rotor is at rest. In this condition, the bucket's pivot pins 21 are seated in their respective hangers and the bucket is free to pivot on the pivot axis defined by the pivot pins. In FIG. 1, the left-most bucket 7 (shown in phantom lines) illustrates the position of bucket 8 when the rotor 20 is rotating at or near its operating speed. It will be noted that in response to the centrifugal force acting on the bucket 7, that it has rotated on its pivot axis approximately 90°, so that its bottom 2 is pointed radially outward.

When the centrifugal force acting on the bucket 7 in a radially outward direction reaches a magnitude sufficient to overcome the resisting force of spring 39, it will cause the pivot pin 21 to translate in the slot 30 pushing against the plunger face 44, compressing spring 39 and enabling the bucket bottom 2 to come in contact with the pressure ring 18. In so doing, the pivot pins 21 are relieved of the support load which is now carried by the pressure ring 18.

An inclined ramp 45 is disposed on the upper side of each hanger 23. The base of the ramp or the point from which the incline ascends 46 is located immediately adjacent opening 29 and the ramp 45 extends in a direction parallel the cylindrical bore 32. While the ramp 45 may be made to be relatively wide without negating its function, it has been found advantageous to reduce the contact surface area of the inclined surface 47. By so doing, the inclined surface 47 can be engaged with less sliding friction by the pivot pin 21 of a centrifuge bucket 8, as which will be more fully discussed later herein. Accordingly, the inclined surface 47 may be advantageously formed as a semi-knife edge as shown by the cross-sectional drawing of FIG. 4. It will be noted, however, that the inclined surface 47 is not a true "knife edge" in that it presents a blunt, rather than a sharp, top-most surface. In an alternative form, the inclined surface, denoted 47*a* in FIG. 5, may be provided with an edge radius as a means of reducing the contact surface area. Various other cross-sectional forms are of course possible, and may also be used with satisfactory results.

In addition to the sliding friction developed in sliding down the inclined ramp 45, the bucket pivot pin 21 also encounters rotational friction when rotating on its pivot axis during centrifugation. It has been found advantageous, therefore, to employ a lubricant to reduce this friction and the wear resulting therefrom. In particular, it is believed that the operation of the device would benefit by coating or impregnating one or more of the contact surfaces with a solid lubricant. For example, the inclined surface 47 of ramp 45 may be coated or impregnated on its outer surface with a low friction fluorocarbon compound such as tetrafluoroethylene, graphite or the like. The pivot pin 21 may be similarly treated with one of these materials or with one capable of enduring higher contact pressures such as a compound incorporating molybdenum disulfide. Depending on the force regime for which the centrifuge is designed, it may be advantageous to hard coat the surfaces of the pivot pin 21 by one of the numerous processes known in the manufacturing art such as nitriding or hard plating with nickel or chromium metal.

In preparing a centrifuge for operation, users often remove the buckets to a remote location in order to more conveniently load them with the samples to be centrifuged. In the past, it was critically important that the user correctly reinstall the buckets in the rotor of the centrifuge; otherwise, serious damage could occur when commencing operation. As shown in FIG. 1, a properly installed bucket 8 has both of its pivot pins 21 seated in their respective hangers 23*a* and 23*b*. If the bucket were deposited on the rotor with its pivot pins on the centripetal side of the hanger openings 29, that is to say, with the pivot pins somewhere between the center member 14 and the hanger opening 29, the centrifugal force acting on the bucket would cause it to move in a radially outward direction, whereupon the pivot pins would likely engage and become self-seated in the hanger openings 29. If, however, the user were instead to inadvertently locate the bucket with the pivot pins 21 on the centrifugal side of their respective hanger openings 29 (i.e., radially outward of openings 29), there would be no possibility of such engagement and the bucket would be flung about the centrifuge chamber and collide with the spinning rotor.

Accordingly, a feature of the present invention is the provision of a hanger 23 having ramp means disposed on the upper side thereof for guiding a pivot pin 21 of a bucket 8 into the hanger opening 29. This feature enables a pivot pin to be self-seating in the hanger through the effect of gravity when the bucket is deposited in the rotor of the centrifuge. In other words, the user may simply deposit a bucket 6 (shown in phantom lines at the top of FIG. 1), in the appropriate location of the rotor 10 (i.e., space 13) so that pivot pins 21 engage the ramp surfaces 45 and the bucket 6 will slide down the incline of ramp 45 until the pivot pins 21 engage and become self-seated in the hanger openings 29.

It will be seen that the disclosed arrangement effectively augments whatever skill and attention is exercised by the user to assure that the buckets are correctly seated in the rotor. By the use of the inclined ramp herein disclosed and the automatic seating action resulting therefrom, the likelihood of a mishap occurring involving an unsecured bucket is greatly reduced. Thus, it will be seen that the invention materially enhances the safety and convenience of centrifuge operation.

Figure 7:
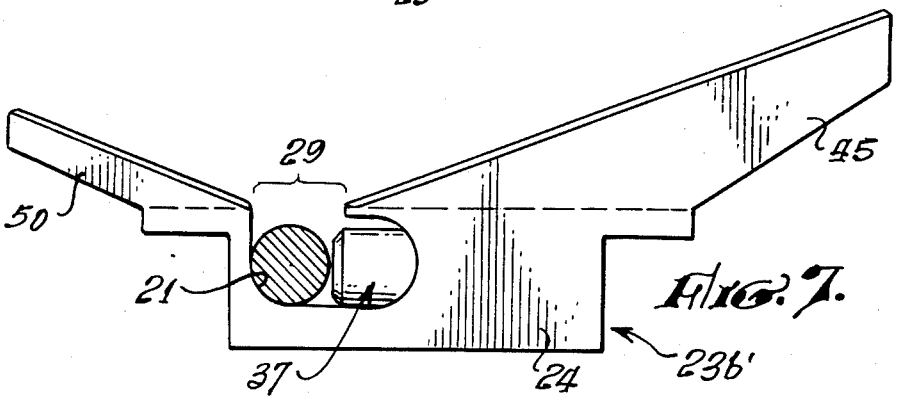
FIG. 7 is a side elevation of one of the hangers of FIG. 6.
Figure 8:
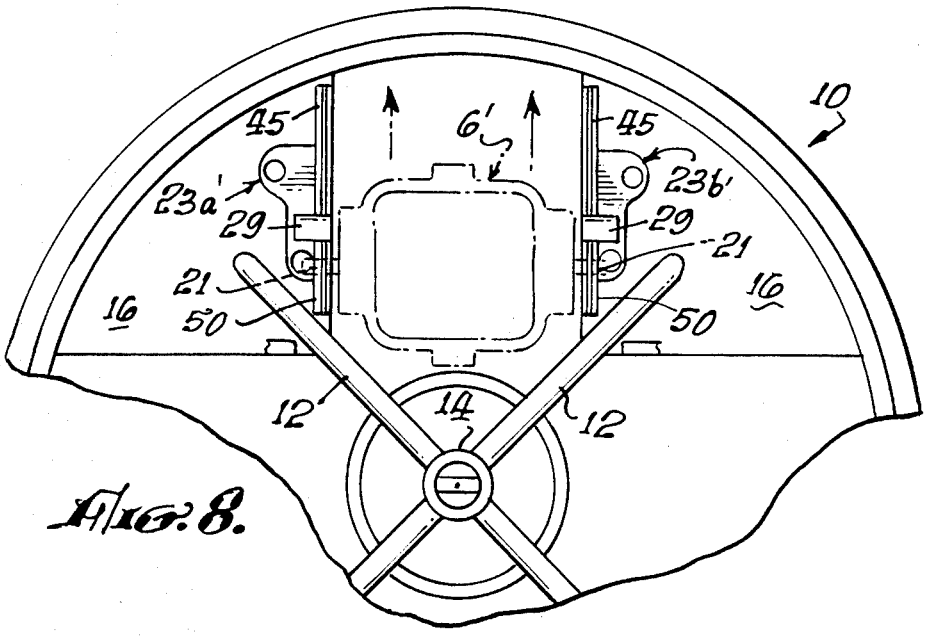
FIG. 8 is a partial plan view of a centrifuge rotor incorporating a pair of hangers constructed in accordance with the present invention as illustrated by FIG. 6.

Referring now also to FIGS. 6–8, the hanger of the invention is depicted in another alternate embodiment in which all features are identical with those that have been thus far disclosed herein, except that there has been added a second ramp 50 to each hanger 23. When a bucket 6' is deposited in the rotor such that each pivot pin 21 is on the centripetal side of the hanger opening 29, the second ramp 50 automatically guides the pivot pin 21 into the hanger opening 29 through the effect of gravity. Thus, the second ramp 50 enables the bucket pivot pins 21 to be self-seating in their hangers 23' while the rotor is at rest, in the same manner as described for the first ramp 45. The second ramp 50 will be seen as providing an additional measure of safety, since the selfseating action of the bucket pivot pins with respect to their hangers is effected without requiring rotation of the rotor and is achieved with a greater degree of certainty therefor.

While in accordance with the patent statutes there has been described what at present is considered to be the preferred embodiments of the invention, it will be understood by those skilled in the art that various changes and modifications may be made therein without departing from the invention and it is, therefore, the aim of the appended claims to cover all such changes and modifications as fall within the true spirit and scope of the invention.

What is claimed is:

1. A self-loading hanger for supporting one side of a swinging bucket in a centrifuge rotor, said hanger adapted for mounting, one on either side, of a space in said rotor for containing said bucket, said bucket having a pivot axis defined by a pair of pivot pins disposed one on each side thereof, said hanger having an opening for receiving one of said pivot pins, said hanger having spring means enabling translation of said pivot axis in said hanger when centrifugal force acting on said bucket overcomes the resistance of said spring means, comprising:

ramp means disposed on the upper side of said hanger for guiding a pivot pin of said bucket into said opening of said hanger, thereby enabling said pivot pins to be self-seating in said hanger by the influence of gravity when said bucket is deposited in said rotor.

2. The hanger defined in claim 1, wherein said ramp means comprises an inclined ramp having its base adjacent the opening of said hanger.

3. The hanger defined in claim 1, wherein said ramp means comprises first and second opposing inclined ramps, each having their base adjacent the opening of said hanger.

4. The hanger defined in claim 1 wherein said spring means exert no force on said pivot pin when said centrifuge rotor is at rest.

5. A hanger for supporting a pivotal element mounting a swinging bucket in a centrifuge rotor and defining a pivotal axis therefor, said hanger adapted for use adjacent to a space in said rotor for receiving said bucket, said hanger having an opening for receiving and capturing a pivotal element for support of said bucket, comprising, ramp means upwardly directed from said hanger and inwardly declining toward the center of said rotor, for receiving and guiding a pivotal element mounting said bucket into said opening of said hanger, thereby enabling said pivotal element to be self-seating in said hanger by gravitational force when said bucket is deposited within said space in said rotor for receiving said bucket.

6. The hanger defined in claim 5 wherein said ramp means further comprises a contact surface for receiving a pivotal element having a semi-knife edge cross section to reduce the contact area of said surface with said pivotal element to reduce sliding friction developed therebetween.

7. The hanger defined in claim 5 wherein said ramp means further comprises a radius formed at the edge of said contact surface to minimize the surface contact between said contact area and said pivotal element to reduce sliding friction developed therebetween.

8. The hanger defined in claim 5 wherein said ramp means further comprises a coating of a compound from the family of fluorocarbons for reducing friction applied thereto, to reduce sliding friction between said ramp means and said pivotal element.

9. A hanger for supporting a pivotal element mounting a swinging bucket to a centrifuge rotor and defining a pivotal axis therefor comprising an elongate horizontal body having an upward vertical opening formed therein for receiving said pivotal element and a channel outwardly directed from said opening to permit said pivotal element to move vertically outwardly after entering said opening such that said pivotal element is captured within said channel, and having ramp means upwardly extending from said body and inwardly declining toward the center of said rotor for receiving and guiding a pivotal element mounting said bucket vertically inwardly for entry into said opening formed in said body, thereby enabling said pivotal element to be self-seating in said hanger by the effect of gravitational force when said bucket is mounted to said rotor.

10. The hanger of claim 9 further comprising biasing means mounted to said body for urging said pivotal element inwardly when said pivotal element enters said channel defined within said body.

* * * * *